US005349373A

United States Patent [19]

Matsumoto et al.

[11] Patent Number: 5,349,373

[45] Date of Patent: Sep. 20, 1994

[54] THERMAL HEAD DRIVE UNIT

[75] Inventors: Yasuki Matsumoto, Hirakata; Haruo Yamashita, Osaka; Yoshihiro Mushika, Neyagawa; Hideshi Ishihara, Takatsuki, all of Japan

[73] Assignee: Matsushita Electric Industrial Co., Ltd., Kadoma, Japan

[21] Appl. No.: 898,442

[22] Filed: Jun. 15, 1992

[30] Foreign Application Priority Data

Jun. 14, 1991 [JP] Japan ..... 3-142929

[51] Int. Cl.[5] ..... B41J 2/36

[52] U.S. Cl. ..... 346/76 PH

[58] Field of Search ..... 346/76 PH, 140 R; 400/120

[56] References Cited

U.S. PATENT DOCUMENTS 4,704,617 11/1987 Sato et al. ..... 346/76 PH

FOREIGN PATENT DOCUMENTS 0171673 9/1984 Japan ..... 346/76 PH
0071272 4/1985 Japan ..... 346/76 PH
0029558 2/1986 Japan ..... 346/76 PH
0159067 7/1988 Japan ..... 346/76 PH
6385714 2/1990 Japan .

*Primary Examiner*—Benjamin R. Fuller
*Assistant Examiner*—N. Le
*Attorney, Agent, or Firm*—Ratner & Prestia

[57] ABSTRACT

A thermal head drive unit comprises electric power supply means for supplying electric power to heat-generating resistor elements arranged in a line in a thermal head. Head drive means is provided for electrically driving the heat-generating resistor elements in a lump by supplying electric power continuously variably in time to the heat-generating resistor elements depending on input gradation data. Head drive control means controls the head drive means in such a manner that, in a one-line recording time period composed of a power supply time during which electric power is supplied to the heat-generating resistor elements and an intermission time during which no electric power is supplied to the heat-generating resistor elements in disregard of the gradation data, the intermission time occupies a part not more than approximately 40% in the one-line recording time period.

6 Claims, 9 Drawing Sheets

THERMAL HEAD DRIVE UNIT

BACKGROUND OF THE INVENTION

1. Field of the Invention

The present invention relates to a thermal head drive unit for use in a thermal color generating type or thermal ink transfer type recording apparatus or the like employing a thermal head.

2. Description of the Prior Art

In recent years, there has been proposed a variety of thermal head drive units to increase the operation speed and achieve an improvement of effective use of recording energy in a thermal color generating type or thermal ink transfer type recording apparatus.

As a conventional example designed to achieve an efficient use of recording energy, there is a thermal head drive unit disclosed in the Japanese Patent Laid-open Publication No. 43060/1990.

FIG. 10 shows a thermal head drive timing chart of the conventional thermal head drive unit, while FIG. 11 shows the construction of the thermal head driven by means of the conventional thermal head drive unit.

Referring to FIG. 11, the thermal head comprises 2560 units of, heat-generating resistor elements R1 through R2560, transistor pairs ($tr1_1$, $tr2_1$) through ($tr1_{2560}$, $tr2_{2560}$), gates G1 through G2560, latch circuits consisting of D-flip-flop circuits $FF1_1$ through $FF1_{2560}$ and shift resisters consisting of D-flip-flop circuits $FF2_1$ through $FF2_{2560}$. The 2560 units of heat-generating resistor elements R1 through R2560 includes a first block consisting of the odd-numbered resistor elements R1, R3, . . . , R2559 and a second block consisting of the even-numbered resistor elements R2, R4, . . . , R2560.

As shown in FIG. 10, the odd-numbered gates G1, G3, . . . , G2559 are turned on according to a strobe 1 signal, so that the odd-numbered transistor pairs ($tr1_1$, $tr2_1$), ($tr1_3$, $tr2_3$), . . . , ($tr1_{2559}$, $tr2_{2559}$) are turned on/off according to the data in the latch circuits $FF1_1$, $FF1_3$, . . . , $FF1_{2559}$. Thus, the heat-generating resistor elements R1, R3, . . . , R2559 belonging to the first block are supplied with electric power by a power source according to the on/off operation of the transistors thereby to effect energy application to the thermal head. In the same manner, the even-numbered gates G2, G4, . . . , G2560 are turned on according to a strobe 2 signal, so that the even-numbered transistor pairs ($tr1_2$, $tr2_2$), ($tr1_4$, $tr2_4$), . . . , ($tr1_{2560}$, $tr2_{2560}$) are turned on/off according to the data in the latch circuits $FF1_2$, $FF1_4$, . . . , $FF1_{2560}$. Thus, the heat-generating resistor elements R2, R4, . . . , R2560 belonging to the second block are supplied with electric power by the power source according to the on/off operation of the transistors thereby to effect energy application to the thermal head.

In the conventional thermal head drive unit having such a construction as mentioned above, the heat-generating resistor elements belonging to the odd-number and even-number blocks of the thermal head alternately receive electric power in the duty ratio of 50% per every gradation and the alternate drive operation thereof are repeated, The amount of heat generation is controlled by varying the number of electric pulses supplied to the heat-generating resistor elements for recording each dot with successively applying energy without providing any intermission between the time of maximum energy application to one recording line and the time of energy application to the subsequent line thereby to increase the efficiency of energy use.

For the purpose of achieving a higher rate of recording operation, there is proposed a second conventional example in which electric power applied to the heat-generating resistor elements of a thermal head is made as large as possible while reducing the time of supplying electric power to the thermal head (refer to pages 1155 through 1161 of "Color hard copy apparatus for electronic still camera by means of a sublimation type thermal die transfer system" in Vol. 39, No. 12 (1985) of Television Academy Journal).

Generally, a thermal head is used with applying an extremely short pulse electric power thereto, and in such a use condition, each heat-generating resistor element has a life span depending on the total pulse amount applied thereto, the life span normally corresponding to $10^7$ to $10^8$ pulses (refer to pages 350 to 352 of "Hard Copy Technology" issued by Japan Industrial Engineer-Center (JIEC)). Therefore, the first example of the conventional thermal head drive unit repeats turning on/off of electric power supply to the resistor elements every gradation, resulting in that 255 times in maximum of electric pulse power application to the heat-generating resistor elements is conducted per a recording line. The above also incurs a problem of life span reduction of the heat-generating resistor elements due to a frequent pulse application as well as a problem that, since the thermal head is driven with the resistor elements divided at least into two blocks, it is necessary for the thermal head to provide a special wiring, connector, signal line and the like, resulting in increase of the thermal head drive unit.

Furthermore, in the first conventional thermal head drive unit, there is provided no intermission between the time of the maximum energy application to one recording line and the time of the energy application to the subsequent line so as to increase the energy use efficiency and reduce the recording time. However, the provision of no intermission incurs another problem that heat accumulation in the previous line exerts a significant influence on the current line, which results in blurring an edge of an image or blurring a low-gradation portion and the like. (The above-mentioned phenomenon is referred to as "a tailing phenomenon" hereinafter.) Such a tailing phenomenon is not so conspicuous in a degree of an image quality-formed through recording with a source of an NTSC video signal having the same resolution, however, in recording a high vision image with a high-resolution or such an image having a lot of continuous low-density areas as in computer graphics, degradation of image quality due to the tailing phenomenon cannot be ignored.

In addition, there practically occur a variance in recording density due to deviation in resistance of the heat-generating resistor elements in the thermal head as well as variance in recording density due to environmental temperature change and due to heat accumulation in the thermal head, and therefore, compensation is necessary for the variance in recording density. Such compensation can be effected by increasing or decreasing electric power supply time data input with an application voltage made constant so that each heat-generating resistor element yields the same recording heat energy. However, in the first conventional thermal head drive unit, due to the fact that no intermission is provided between the time of maximum energy application to one recording line and the time of energy application to the subsequent line, it is impossible to eliminate such disadvantages of deterioration of image quality due to the tailing phenomenon, variance in recording density due to deviation in resistance of the heat-generating elements, and variance in recording density due to environmental temperature change and heat accumulation in the thermal head itself.

Otherwise, as described in the second conventional example, when electric power application to the thermal head is increased while reducing the electric power supply time period, the heat-generating resistor elements tend to have such an elevated temperature that causes deformation of a recording paper or an ink sheet due to generated heat. When the elevated temperature of the heat-generating resistor elements exceeds the temperature at which the recording paper starts to be deformed, the heat energy generated from the thermal head is consumed as energy for deforming the recording paper or ink sheet other than energy for transferring the ink. The above fact also causes a problem in efficiency of energy use as well as deformation in dot size order of the recording paper surface corresponding to each heat-generating resistor element, which results in reducing the recording density due to irregular reflection of light and causing deterioration of image quality due to luster loss of the recording paper.

SUMMARY OF THE INVENTION

The present invention has been developed with a view to substantially solving the above described disadvantages and has its essential object to provide an improved thermal head drive unit which is capable of employing a thermal head having a simple construction, increasing the life span of each heat-generating resistor element, correcting variance in recording density due to deviation in resistance of the heat-generating elements and variance in recording density due to environmental temperature change and due to heat accumulation in the thermal head, achieving heat generation of the heat-generating resistor elements of the thermal head with high energy use efficiency, thereby preventing reduction of recording density as well as deterioration of image quality due to heat deformation of the recording paper surface.

In order to achieve the aforementioned object, the improved thermal head drive unit according to the present invention comprises:

electric power supply means for supplying electric power to heat-generating resistor elements arranged in a line in a thermal head;

head drive means for electrically driving the heat-generating resistor elements in a lump by supplying electric power to the heat-generating resistor elements with continuously varying the power supply time according to gradation data to be input; and head drive control means for controlling the head drive means in such a manner that, in a one-line recording time consisting of a power supply time in which electric power is supplied to the heat-generating resistor elements and an intermission time in which any electric power is not supplied to the heat-generating resistor elements in disregard of the gradation data, the intermission time occupies a part not more than approximately 40% in the one-line recording time.

According to the thermal head drive unit of the present invention, the electric power supply means supplies such a maximum electric power that the maximum temperature of the heat-generating resistor elements is lower than a temperature at which a recording paper is thermally deformed, wherein an image is formed on the recording paper through a color generation or ink transfer process.

Furthermore, according to the thermal head drive unit of the present invention, the head drive control means controls the head drive means in such a manner that substantially no intermission time is provided in a time period for carrying out a compensation operation with maximum additional electric power supply necessary for compensating a recording density variance attributed to environmental temperature change and attributed to heat accumulation in the thermal head and/or compensating a recording density variance attributed to deviation in resistance of the heat-generating resistor elements.

With the construction of the present invention as described above, the heat-generating resistor elements are driven in a lump with electric power supply, and therefore no means is necessary for dividedly driving the thermal heads thereby enabling to construct a simple printer to which the thermal head is incorporated. By continuously supplying electric power to the heat-generating resistor elements according to gradation data for each recording line without providing any intermission, only one pulse representing heating or intermission takes place in each recording line to enable increasing the life span of each heat-generating resistor element against heat due to pulse application.

Furthermore, with the provision of the head drive control means for controlling the head drive means, in a one-line recording time composed of a time at which electric power is supplied to the heat-generating resistor elements and an intermission time at which no electric power is supplied to the heat-generating resistor elements in disregard of the gradation data, the intermission time occupies a part not more than approximately 40% in the one-line recording time, whereby the possible decrease of an elevated temperature in an intermission time can be suppressed to be minimum in each recording line, and the supplied energy can be efficiently used in the heat-generating operation for the next line.

Furthermore, the electric power supply means supplies to the heat-generating resistor elements such maximum electric power that the heat-generating resistor elements yield a maximum temperature lower than a temperature at which the recording paper for producing an image through a color generation or ink transfer process is deformed, whereby the possible deformation of the recording paper surface can be eliminated to prevent the possible recording density reduction and image quality deterioration attributed to the deformation of the recording paper surface due to heat.

The arrangement that substantially no intermission time is provided in a time period for carrying out a compensation operation with maximum additional electric power supply necessary for temperature compensation and resistance correction corresponds to the case that the gradation level is great at a low temperature for recording an image having a comparatively high density area, and therefore image quality deterioration due to the tailing phenomenon is hardly recognized. Furthermore, resistance correction and temperature compensation can be introduced to enable improving the gradation reproductibility of a recording image.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

A first embodiment of the present invention is a thermal head drive unit which is capable of carrying out a multi-gradation recording operation in a main scanning direction with $2^n$ (n: natural number) units of heat-generating resistor elements arranged in a line in a thermal head and driven in a lump.

Figure 1:
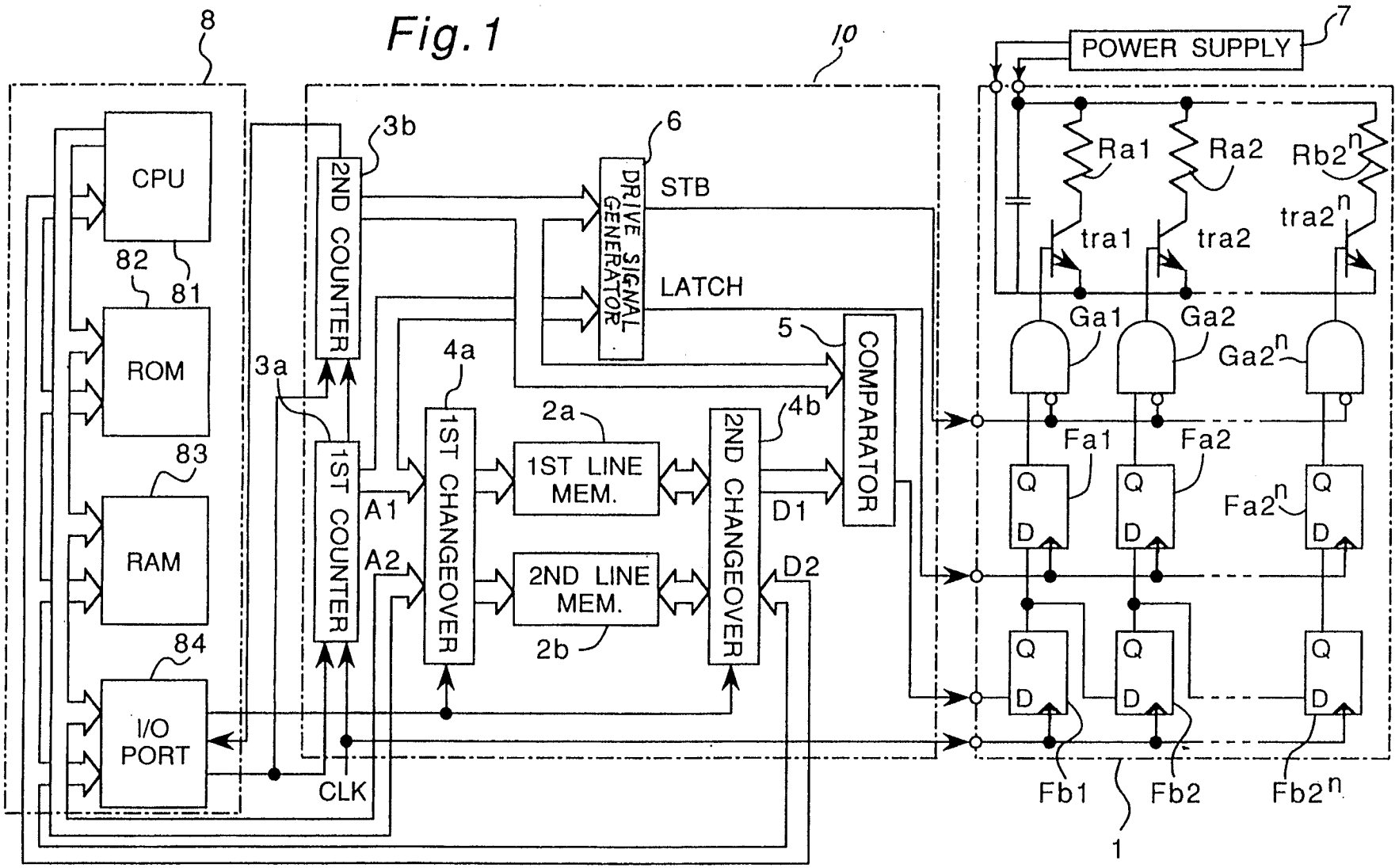
FIG. 1 is a block diagram of a thermal head drive unit in accordance with an embodiment of the present invention.

FIG. 1 shows a thermal head drive unit of the first embodiment.

Referring to FIG. 1, designated by reference numeral 1 is a thermal head, 2*a* and 2*b* are first and second line memory units for storing electric power supply time data for supplying electric power to heat-generating resistor elements Ra1 through Ra2$^n$ according to input gradation level data of each pixel, 3*a* is a first counter for generating an address signal for reading data in the first line memory 2*a* or the second line memory 2*b*, 3*b* is a second counter for generating a signal representing the frequency of reading electric power supply time data for each line in the first line memory 2*a* or the second line memory 2*b*, 4*a* is a first changeover means for changing over between address data given to the first line memory 2*a* and address data given to the second line memory 2*b*, 4*b* is a second changeover means for changing over between output data from the first line memory 2*a* and output data from the second line memory 2*b*, 5 is a comparator for outputting serial data DATA obtained by comparing the output from the first line memory 2*a* or the output from the second line memory 2*b* read out according to the address given from the first counter 3*a* output via the second changeover means 4*b* with an output from the second counter 3*b*, 6 is drive signal generating means for generating a latch signal LATCH and a strobe signal STB for driving the head, 7 is electric power supply means for supplying electric power to heat-resistor elements Ra1 through Ra2$^n$ in the thermal head 1, and 10 is head drive control means including the line memories 2*a* and 2*b*, the first and second counters 3*a* and 3*b*, the comparator 5, and the drive signal generator means 6. The thermal head drive unit is further provided with a head drive control means 8 for controlling the first and second counters 3*a* and 3*b*, the first and second changeover means 4*a* and 4*b* to control the recording operation for each line. The head drive control means 8 is composed of a microcomputer comprising a CPU 81, a ROM 82 for storing a program for the CPU 81, a RAM 83 for storing calculation results by the CPU 81 and other data, and an input/output port 84 which receives a carry signal output from the second counter 3*b* and controls counting start and stop of the first counter 3*a* and the second counter 3*b* as well as changeover between the first changeover means 4*a* and the second changeover means 4*b*.

With the above-mentioned construction, an address bus A2 of the microcomputer in the head drive control means: 8 is input to the first changeover means 4*a*, while a data bus D2 is connected to the output of the second changeover means 4*b*. The first changeover means 4*a* and the second changeover means 4*b* are changed over in an interlinking manner. When a connection between the address bus A1 and the data bus D1 via the first line memory 2*a* is selected, it is changed to a connection between the address bus A2 and the data bus D2 via the second line memory 2*b*. When a connection between the address bus A1 and the data bus D1 via the second line memory 2*b* is selected, it is changed to a connection between the address bus A2 and the data bus D2 via the first line memory 2*a*. The thermal head 1 has substantially the same construction as the thermal head employed in the first conventional example except that, in the first embodiment, only one strobe signal STB is employed to drive the heat-generating resistor elements in a lump with supply of electric power. Practically, the thermal head of the first embodiment comprises $2^n$ units of heat-generating resistor elements Ra1 through Ra2$^n$, transistors tra1 through tra2$^n$, gates Ga1 through Ga2$^n$, a latch circuit comprising D-flip-flops Fa1 through Fa2$^n$, a shift register comprising D-flip-flops Fb1 through Fb2$^n$.

Figure 2:
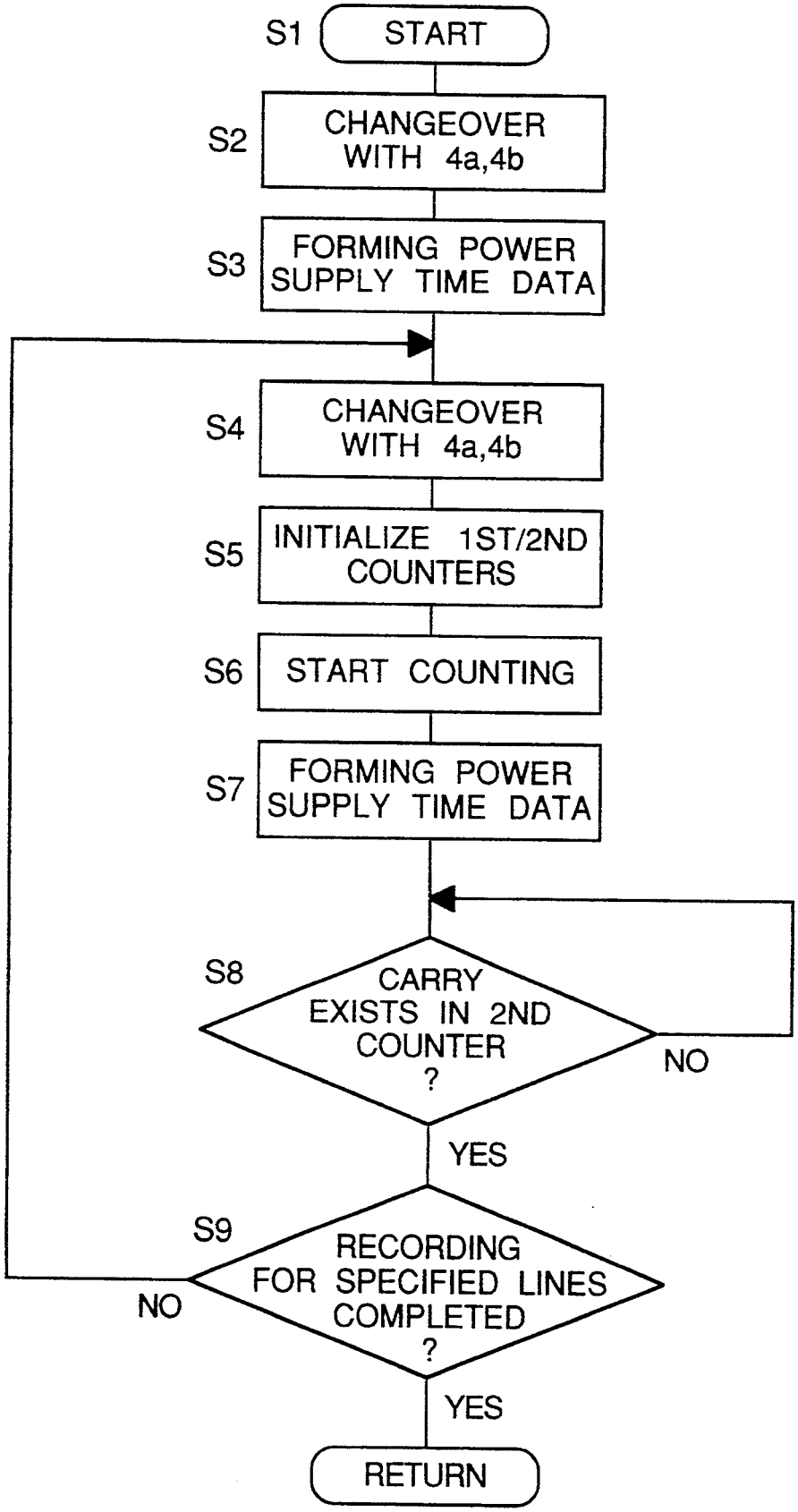
FIG. 2 is a flow chart showing an operation of head drive control means in the thermal head drive unit according to the embodiment of the present invention.
Figure 3:
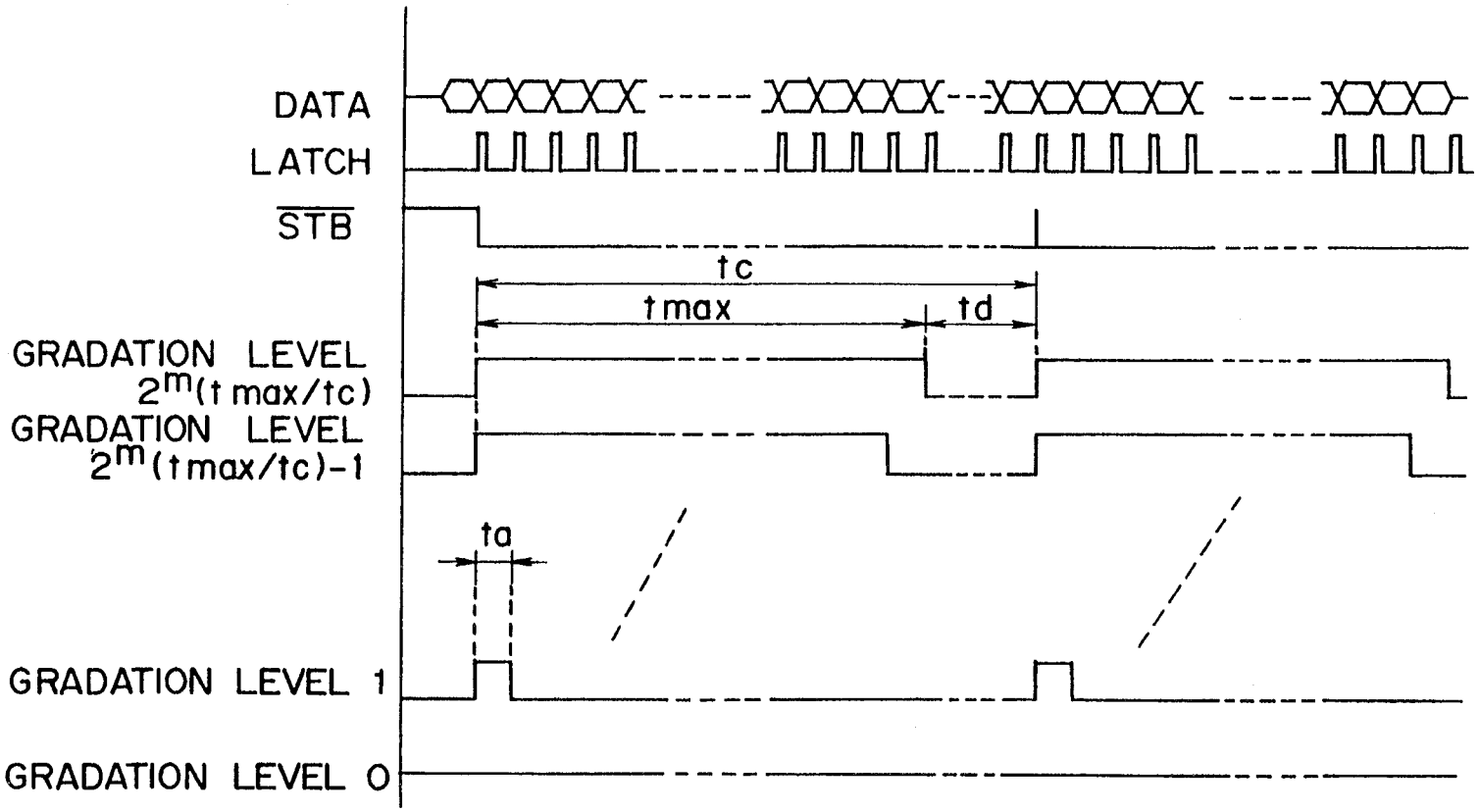
FIG. 3 is a timing chart of a thermal head drive operation by means of the thermal head drive unit according to the embodiment of the present invention.

FIG. 2 shows a flow chart of the operations of the head drive control means 8, while FIG. 3 shows a timing chart of the operations of the thermal head 1.

The following describes in detail the operations of the first embodiment with reference to FIGS. 1, 2, and 3. The drive signal generating means 6 generates a latch signal LATCH and a strobe signal STB for driving the head. The serial output data from the comparator 5 are converted into parallel data corresponding to each of the heat-generating resistor elements Ra1 through Ra2$^n$ in synchronization with a data transfer clock CLK by way of the shift registers Fb1 through Fb2$^n$ to be then latched in the latch circuits Fa1 through Fa2$^n$ according to the latch signal LATCH. Then by making the strobe signal STB active ("L"), the gates Ga1 through Ga2$^n$ are turned on and the transistors tra1 through tra2$^n$ are turned on or off according to the data in the latch circuits Fa1 through Fa2$^n$, whereby electric power is supplied to the heat-generating resistor elements Ra1 through Ra2$^n$ according to the electric power supply time data to consequently generate heat energy.

As described above, the heat-generating resistor elements Ra1 through Ra2$^n$ in the thermal head 1 are driven in a lump with electric power supply according to gradation level data of each pixel so as to vary the heat energy from each of the heat-generating resistor elements Ra1 through Ra2$^n$ thereby to carry out a recording operation for one line.

Referring to FIG. 2, firstly the address bus A1, the first line memory 2*a*, and the data bus D1 are connected together while the address bus A2, the second line memory 2*b*, and the data bus D2 are connected together by means of the first and second changeover means 4*a* and 4*b* in steps S1 and S2. At this time, the microcomputer in the head drive control means 8 forms electric power supply time data based on gradation data input for the first line and then the resulting data is stored in the second line memory 2*b* in step S3. Secondly, the second line memory 2*b* is connected to the address bus A1 and the data bus D1 by means of the first and second changeover means 4*a* and 4*b* in step S4. Subsequently, the first counter 3*a* and the second counter 3*b* are initialized via the input/output port 84, thereafter counting operations start in steps S5 and S6.

At this time, the electric power supply time data corresponding to the heat-generating resistor elements Ra1 through Ra2$^n$ are successively read out according to an output from the first counter 3*a* in step S7. When the first counter 3*a* completes counting by $2^n$ times to read all the data in the second line memory 2*b*, the second counter 3*b* increments its count value by one, and then the data in the second line memory 2*b* are read again from the beginning by means of the first counter 3*a*. The data in the second line memory 2*b* read by means of the first counter 3*a* are input to the comparator 5, and thus the data reading operation is repeated by $2^m$ times (m: natural number) for one line in step S8.

The comparator 5 compares the electric power supply time data in the second line memory 2*b* with output data of the second counter 3*b*. When the output of the second counter 3*b* is not greater than the electric power supply time data, a signal representing "1" is output to the shift register Fb1. In more detail, a cycle process corresponding to a one-gradation recording time $t_a$ as shown in FIG. 3 is repeated $2^m$ times, and then the same data are read from the second line memory 2*b* in every cycle. However, since the count value of the second counter 3*b* increases one by one every cycle, the output data of the second line memory 2*b* is successively changed to "0" in the order from the one which becomes smaller than the count value of the second counter 3*b*. (It is noted that the status "1" corresponds to electric power supply while the status "0" corresponds to electric power supply stop.) As described above, in each of the heat-generating resistor elements of the thermal head 1, the data for determining whether electric power supply is effected ("1": electric power supply or "0": electric power supply stop) is transmitted $2^m$ times in the cycle $t_a$ in FIG. 3. After the counter 3*b* completes counting by $2^m$ times, a carry signal is output to the head drive control means 8 in step S9.

In the meantime, the head drive control means 8 forms an electric power supply time data based on gradation data to be input for the next line so that the resulting data is stored in the first line memory 2*a*. Subsequently, the second counter 3*b* completes counting by $2^m$ times, and then the carry output signal is subject to a polling process. When the carry output is detected, the CPU 81 checks whether recording of a specified amount of lines has been completed. When recording of the specified amount of lines has not been completed, the above-mentioned sequence is repeated. In the above time period, the first changeover means 4*a* and the second changeover means 4*b* carry out changeover operations for every one-line recording cycle in an interlinking manner. Therefore, the address bus A2, the first line memory 2*a*, and the data bus D2 are changed over alternately to the respective counterpart ones every one-line recording cycle in the following manner. When the connection between the address bus A1, the first line memory 2*a* and the data bus D1 and the connection between the address bus A2, the second line memory 2*b* and the data bus D2 are selected, they are changed to the connection between the address bus A1, the second line memory 2*b*, and the data bus D1 and the connection between the address bus A2, the first line memory 2*a*, and the data bus D2. Conversely, when the connection between the address bus A1, the second line memory 2*b* and the data bus D1 and the connection between the address bus A2, the first line memory 2*a* and the data bus D2 are selected, they are changed to the connection between the address bus A1, the first line memory 2*a*, and the data bus D1 and the connection between the address bus A2, the second line memory 2*b*, and the data bus D2.

The following describes the amount of recording gradation levels. Since the one-line recording cycle tc corresponds to the time when the second counter 3*b* completes counting by $2^m$ times, the one-gradation recording time $t_a$ is fixed at $(tc/2^m)$. In the present embodiment, when setting an intermission time td, the amount of gradations depends on setup values of the maximum electric power supply time tmax and the intermission time td, and the reproducible gradation amount P can be expressed by the Equation 1 as follows.

$$P=2^m*(tmax/tc) \quad (1)$$

The electric power supply time data can be formed based on input gradation data by giving such a ratio that the maximum gradation data takes the value of tmax to each input gradation data. Therefore, with the electric power supply time data formation process based on the gradation data by the head drive control means 8, an intermission time in one-line recording time period is to be set up.

Figure 4:
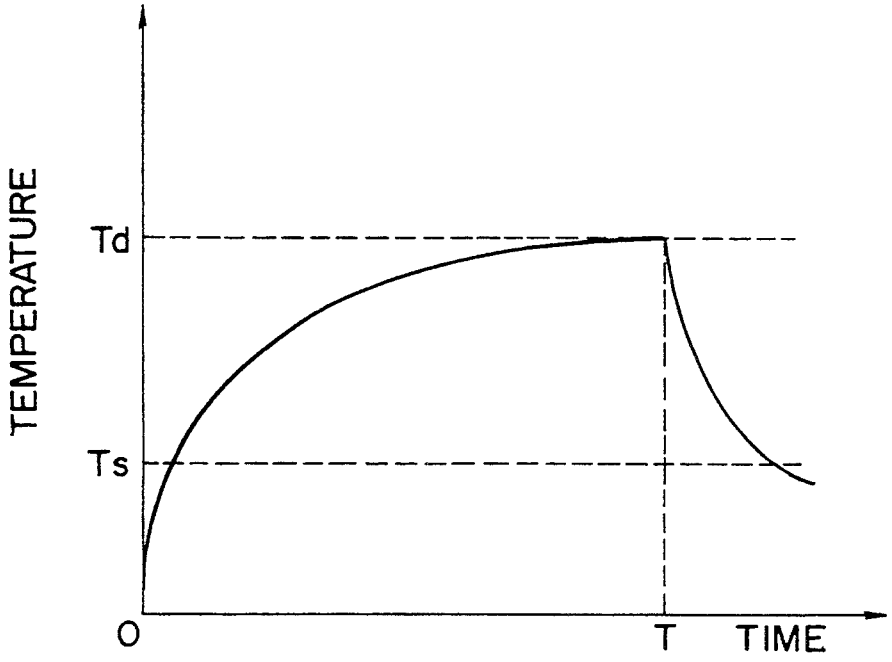
FIG. 4 is a graph showing an experiment result of maximum recording density and recording paper deformation due to heat with supply electric power and electric power supply time being parameters in the thermal head drive unit according to the embodiment of the present invention.

Furthermore, FIG. 4 shows a graph where the vertical axis represents the heat temperature at a heat-generating resistor element while the horizontal axis represents the electric power supply time. Td represents a temperature at which the recording paper starts to deform due to heat. When the heat temperature at the heat-generating resistor element exceeds the temperature, the recording paper starts to deform due to the heat.

Ts represents a temperature at which a recording paper starts to generate color or ink starts to be transferred onto the recording paper. When the heat temperature at the heat-generating resistor element exceeds the above-mentioned temperature Ts, the recording paper generates color or ink is transferred onto the recording paper thereby to record an image onto the recording paper.

In the above case, the heat temperature at the heat-generating resistor element depends on electric power supplied to the heat-generating resistor element, and there is a proportional relation between the supplied electric power and the heat temperature at the heat-generating resistor element within a range where the heat-generating resistor element does not break. Meanwhile, recording density depends on heat energy emitted from the heat-generating resistor element, and heat energy J yielded from the heat-generating resistor element can be expressed by the Equation 2 as follows.

$$J = W \cdot T \quad (2)$$

where J represents the heat energy yielded from the heat-generating resistor element, W represents the electric power supplied to the heat-generating resistor element, and T represents the time of supplying electric power to the heat-generating resistor element.

In principle, when the heat energy J yielded by the heat-generating resistor elements is same, the same recording density will result. In the thermal head drive unit according to the first embodiment, as shown in FIG. 4, supply electric power W is set up according to the maximum electric power supply time T of the heat-generating resistor element in such a manner that the heat-generating resistor element is heated to a temperature which is greater than the temperature Ts at which the recording paper starts to generate color or ink starts to be transferred onto the recording paper and slightly lower than the temperature Td at which the recording paper starts to deform due to the heat.

Figure 5:
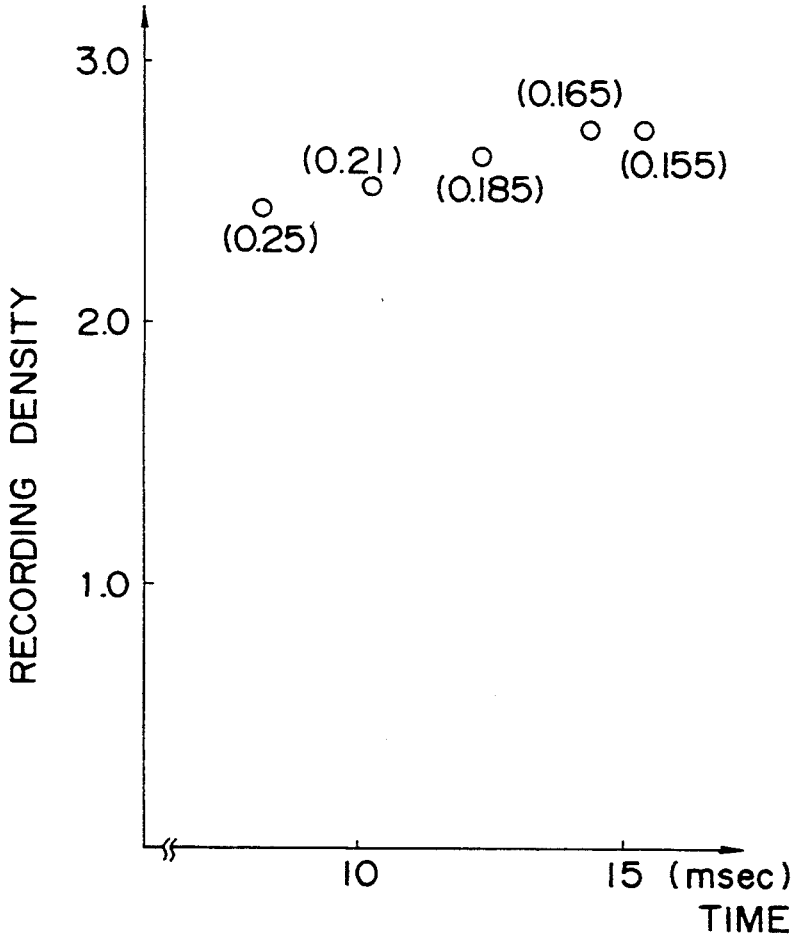
FIG. 5 is a graph showing an experiment result of maximum recording density and recording paper deformation due to heat with supply electric power and electric power supply time being parameters in the thermal head drive unit of the embodiment of the present invention.

FIG. 5 shows an experiment result of the maximum recording density and deformation of recording paper due to heat with the supplied electric power and the electric power supply time being parameters practically taking the above-mentioned relation into account. A thermal head drive unit of the present invention was incorporated to the printer used for the experiment, when the one-line recording time was fixed at 16.4 milliseconds and the maximum electric power supply time was set at each of 10.25, 12.3, 14.35, and 15.375 milliseconds. The horizontal axis represents the maximum electric power supply time, while the vertical axis represents a recording density at the time the recording paper started to deform due to heat. The recording density at the time the recording paper started to deform due to heat gradually increased with increase of the maximum electric power supply time and almost saturated when the maximum electric power supply time exceeded 14.35 milliseconds. The numerals in the parentheses indicate the electric power (W/dot) supplied to the heat-generating resistor element at the time the recording paper started to deform due to heat, the numerals indicating a gradual reduction with respect to the recording pulse width. Therefore, with increase of the electric power supply time, a print exhibiting less deformation due to heat and a higher maximum recording density results so that less supply electric power is achieved, and a maximum recording density free of deformation due to heat can be obtained at least when the maximum electric supply time is not less than 14.35 milliseconds.

The following describes in detail setting of the intermission time td.

So long as the temperature of the heat-generating element is higher than the temperature Ts at which a recording paper starts to generate color or ink starts to be transferred onto the recording paper irrespective of no electric power supplied at a recording start time, density recording takes place in some degree. Therefore, the minimum condition for eliminating the possible influence of the tailing phenomenon is to set up such an intermission time that each heat-generating resistor element has a temperature lower than the temperature Ts at which the recording paper starts to generate color or ink starts to be transferred onto the recording paper.

Figure 6:
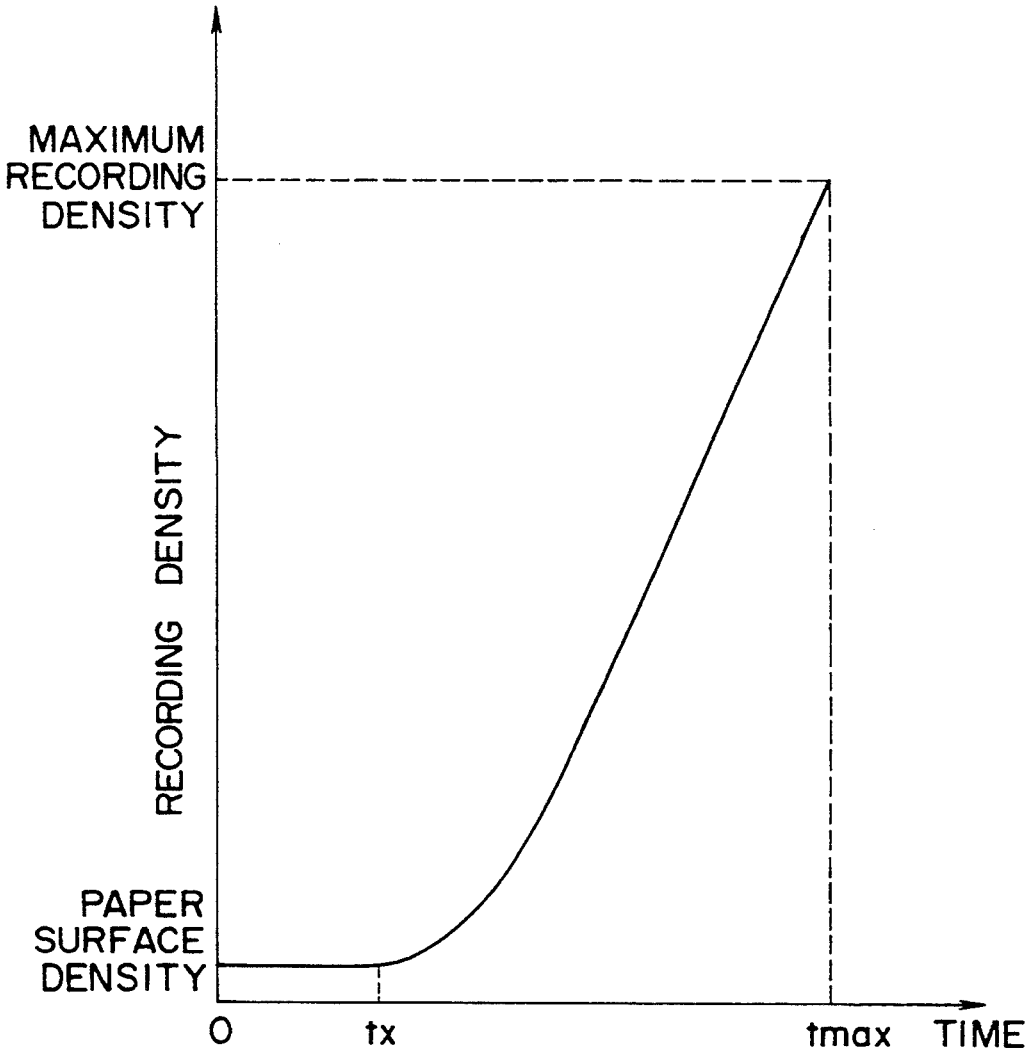
FIG. 6 is a graph of a relation between electric supply time and recording density in the thermal head drive unit according to the embodiment of the present invention.
Figure 7:
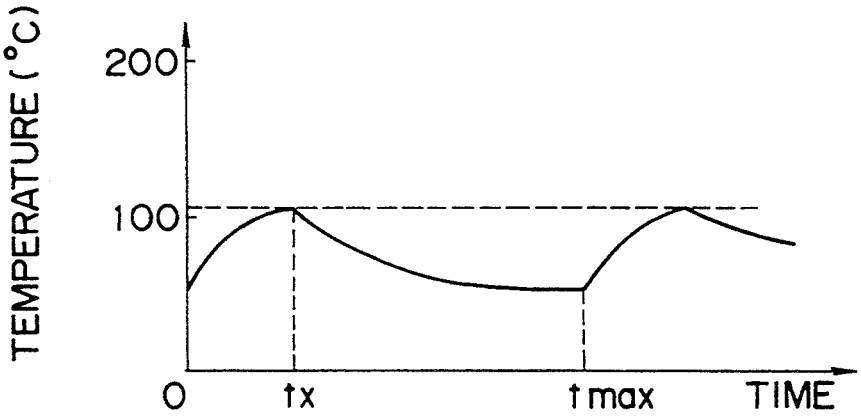
FIG. 7 is a graph showing a heat temperature at a heat-generating resistor element at an electric power supply time $t_a$ in the thermal head drive unit according to the embodiment of the present invention.

FIG. 6 shows a relation between recording density and electric power supply time, where the maximum electric power supply time as shown in FIG. 5 was set at 14.34 milliseconds and the supplied electric power to the heat-generating resistor element was 0.164 W/dot which is the approximate maximum electric power causing no deformation of the recording paper. As shown in FIG. 6, recording density started to increase at the time the power supply time was 4.2 milliseconds. Therefore, the uprise time $t_x$ (approximately 4.2 milliseconds) corresponds to the time at which the temperature of the heat-generating resistor element is increased to exceed the temperature Ts at which a recording paper starts to generate color or ink starts to be transferred onto the recording paper. FIG. 7 shows a graph of a heat temperature of the heat-generating resistor element when the electric supply time is $t_x$. The heat temperature at the heat-generating resistor element reaches the temperature Ts at which a recording paper starts to generate color or ink starts to be transferred onto a recording paper after the elapse of the electric power supply time $t_x$ from the start of a one-line recording time. Therefore, the temperature Ts at which a recording paper starts to generate color or ink starts to be transferred onto the recording paper is approximately 105° C. Usually, the temperature Ts at which a recording paper starts to generate color or ink starts to be transferred onto recording paper is set at about 100° C.

Figure 8:
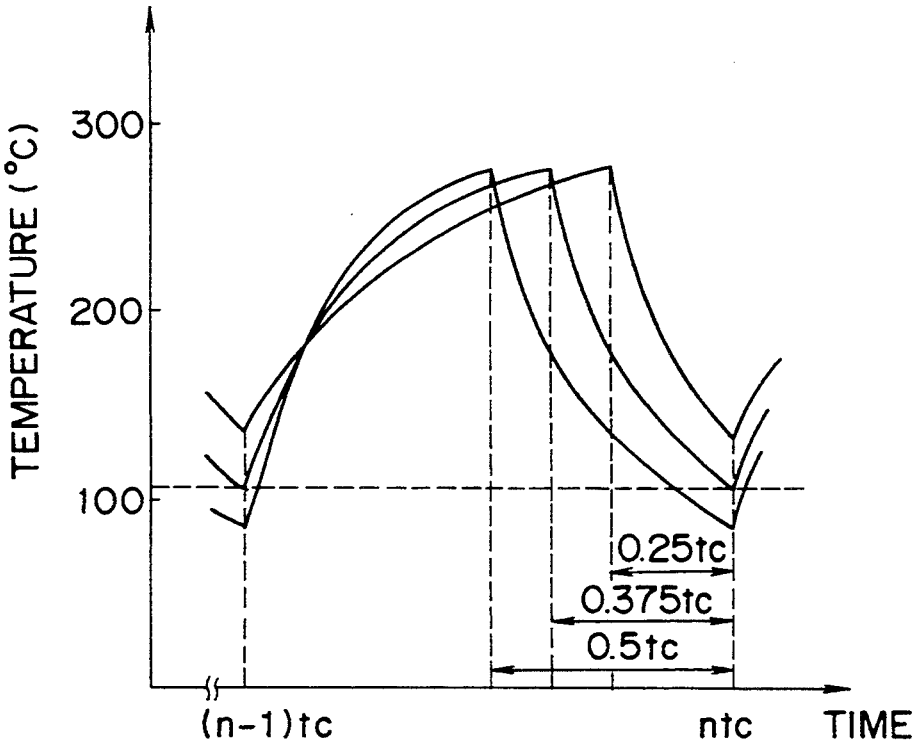
FIG. 8 is a graph showing a temperature at a heat-generating resistor element measured at a time after the elapse of a sufficient time from the start of recording in the thermal head drive unit according to the embodiment of the present invention.

FIG. 8 shows a graph of a temperature of a heat-generating resistor element measured at a time after the elapse of a sufficient time from the start of recording a specified line, where an intermission time in one-line recording cycle is set at each of 50%, 37.5%, and 25% with supply of the maximum electric power at which no deformation of the recording paper takes place as shown in FIG. 5 when setting an environmental temperature at 50° C. As shown in FIG. 8, tc represents one-line recording cycle. When set at 37.5% in one-line recording cycle the intermission time during which the temperature of the heat-generating resistor element reduces from its maximum value, the temperature of the heat-generating resistor element is approximately equal to the temperature Ts at which a recording paper starts to generate color or ink starts to be transferred onto a recording paper. When the intermission time is set at 50% in one-line recording cycle, the temperature at the heat-generating resistor element is sufficiently lower than the temperature Ts. When the intermission time is set at 25% in one-line recording cycle, the temperature of the heat-generating resistor element is higher than the temperature Ts. Therefore, an intermission time being approximately 40% of one-line recording cycle is the approximate minimum time which does not incur the tailing phenomenon without being influenced by heat accumulation in the recording operation for the previous line. In the above-mentioned last condition, a high-quality image recording can be achieved with the minimum reduction of energy use efficiency and recording density without exerting the tailing phenomenon on the next recording line.

As described above, in the first embodiment of the present invention, the intermission time is set at approximately 40% of one-line recording cycle. When the intermission time is set greater than approximately 40%, the heat temperature of the heat-generating resistor element is sufficiently reduced in recording each line without incurring a tailing phenomenon, however in the next recording line a more energy is necessary to make the heat-generating resistor element have a sufficiently high temperature required for a recording operation. In addition, increasing the intermission time gradually reduces the recording density allowing to cause no deformation of the recording paper due to heat, which is disadvantageous in terms of energy use efficiency and recording density.

Further reducing the intermission time leads to an effective use of heat generated in the recording operation in the previous line by the heat-generating resistor elements, increase of energy use efficiency, and gradual increase of recording density without causing recording paper deformation due to heat. On the contrary, use of the accumulated heat leads to the occurrence of the tailing phenomenon resulting in image quality deterioration particularly when the recording operation in the previous line was carried out with electric power supply for the maximum time. It is noted that the tailing phenomenon is not so conspicuous in recording an image based on an NTSC video signal source or a source having the same quality, and practically almost all the images recorded have medium gradations, i.e., electric power supply for the maximum time (recording at the maximum density) scarcely takes place to result in receiving almost no influence from the tailing phenomenon which deteriorates the image quality. Therefore, so long as limitedly selecting images to be recorded, reducing the intermission time between lines leads to increase of recording energy use efficiency and improvement of recording density.

Furthermore, in a thermal recording operation by means of a thermal head, in order to improve the reproduction of gradation, there are a lot of cases requiring a compensation for reducing the variance in recording density due to deviation in resistance of the heat-generating resistor elements as well as a compensation for the variance in recording density due to environmental temperature change and heat accumulation in the thermal head itself. The above-mentioned variable components can be practically compensated by increasing or decreasing the corresponding input electric power supply time data with the application voltage being constant.

In view of the above fact, the following describes a thermal head drive unit in accordance with a second embodiment of the present invention which satisfies the intermission time conditions described on the first embodiment, enables introduction of a compensation for reducing the variance in recording density due to deviation in resistance of the heat-generating resistor elements as well as a compensation for the variance in recording density due to environmental temperature change and heat accumulation in the thermal head itself, and adopts the minimum intermission time assuring the most efficient use of energy.

In the thermal head drive unit of the second embodiment, a margin in an electric power supply time necessary for such as temperature compensation and resistance correction is made to coincide with the intermission time $t_d$. The second embodiment has the same construction as that of the first embodiment and therefore the thermal head is driven in the same manner as in the first embodiment.

Figure 9:
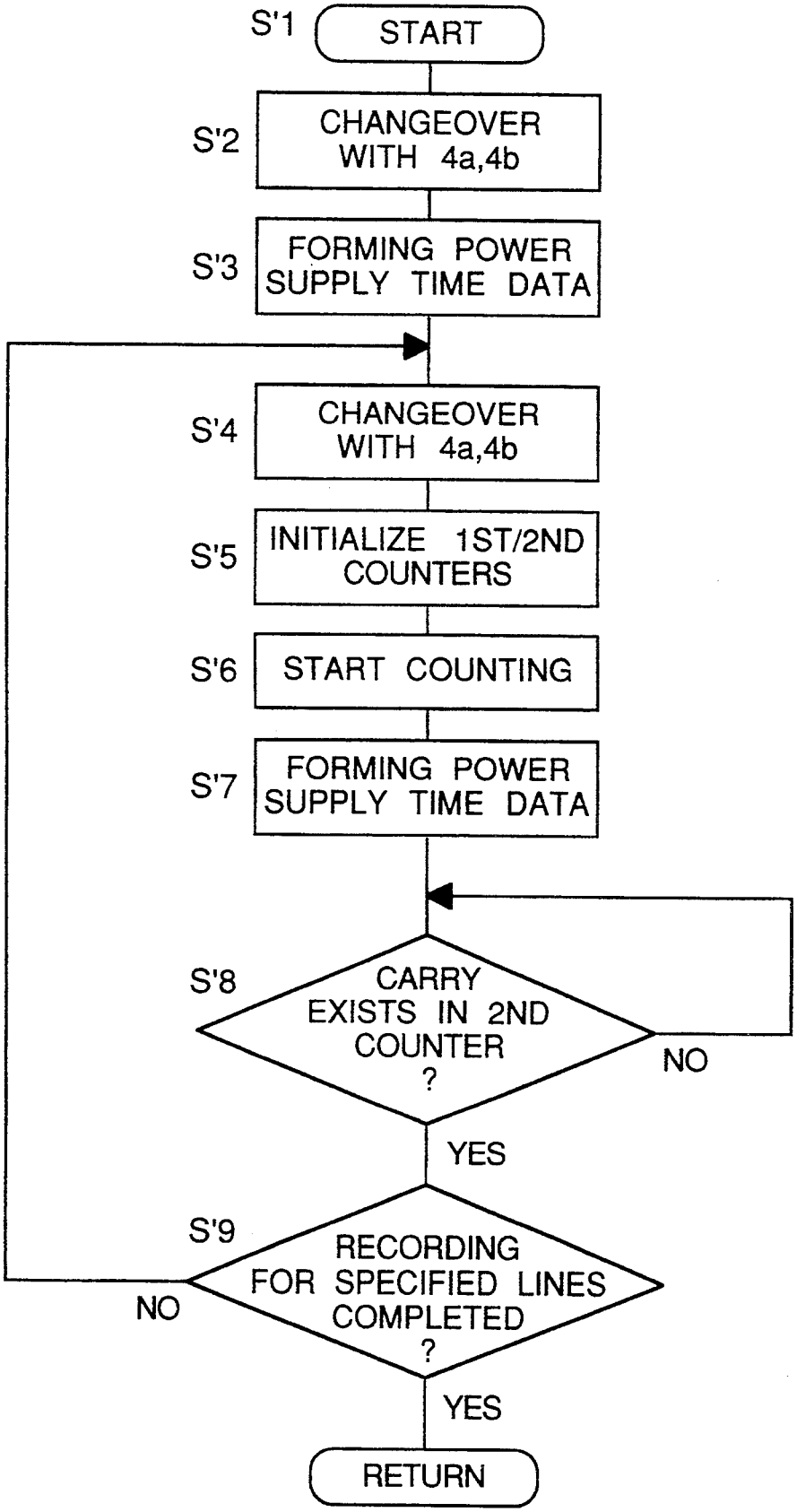
FIG. 9 is a flow chart showing an operation of the head drive control means in the thermal head drive unit in accordance with a second embodiment of the present invention.
Figure 10:
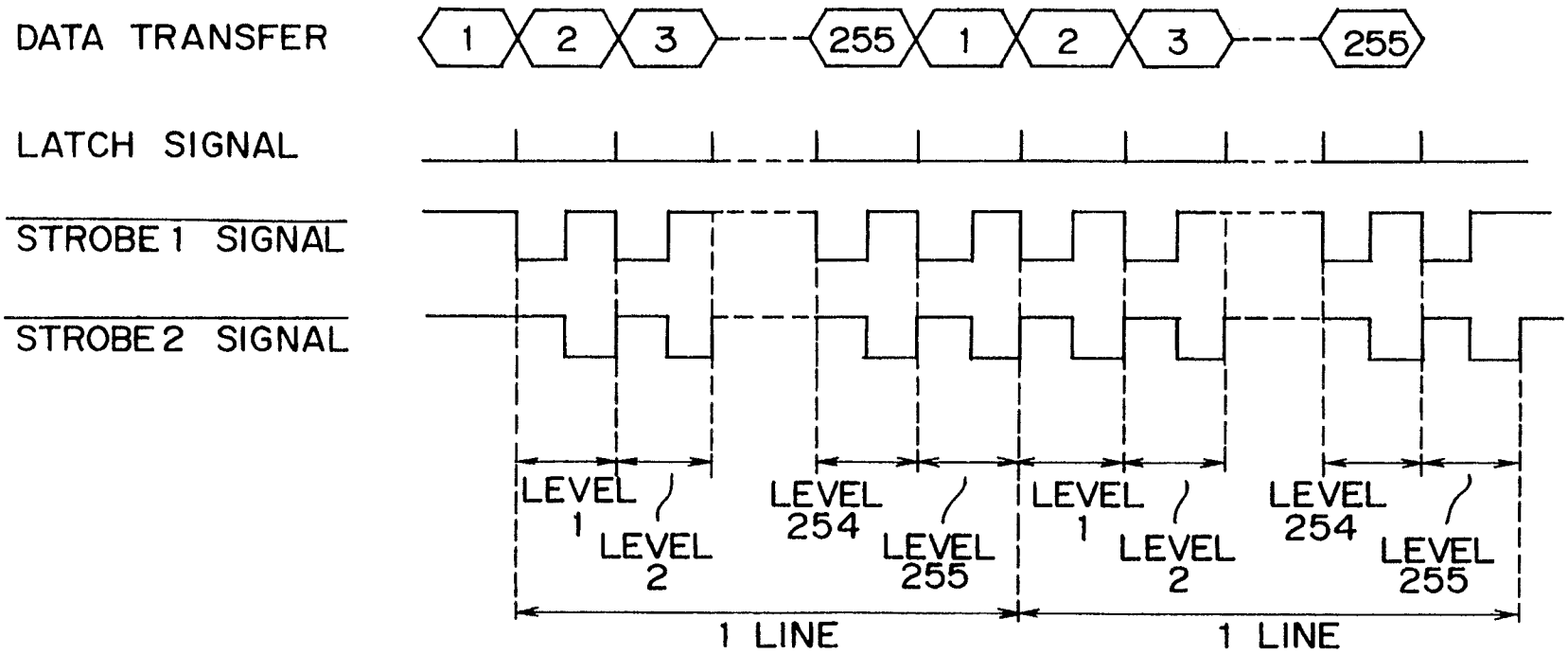
Fig. 10 (Prior Art)
FIG. 10 is a timing chart showing a thermal head drive operation by means of the thermal head drive unit in accordance with a conventional example.
Figure 11:
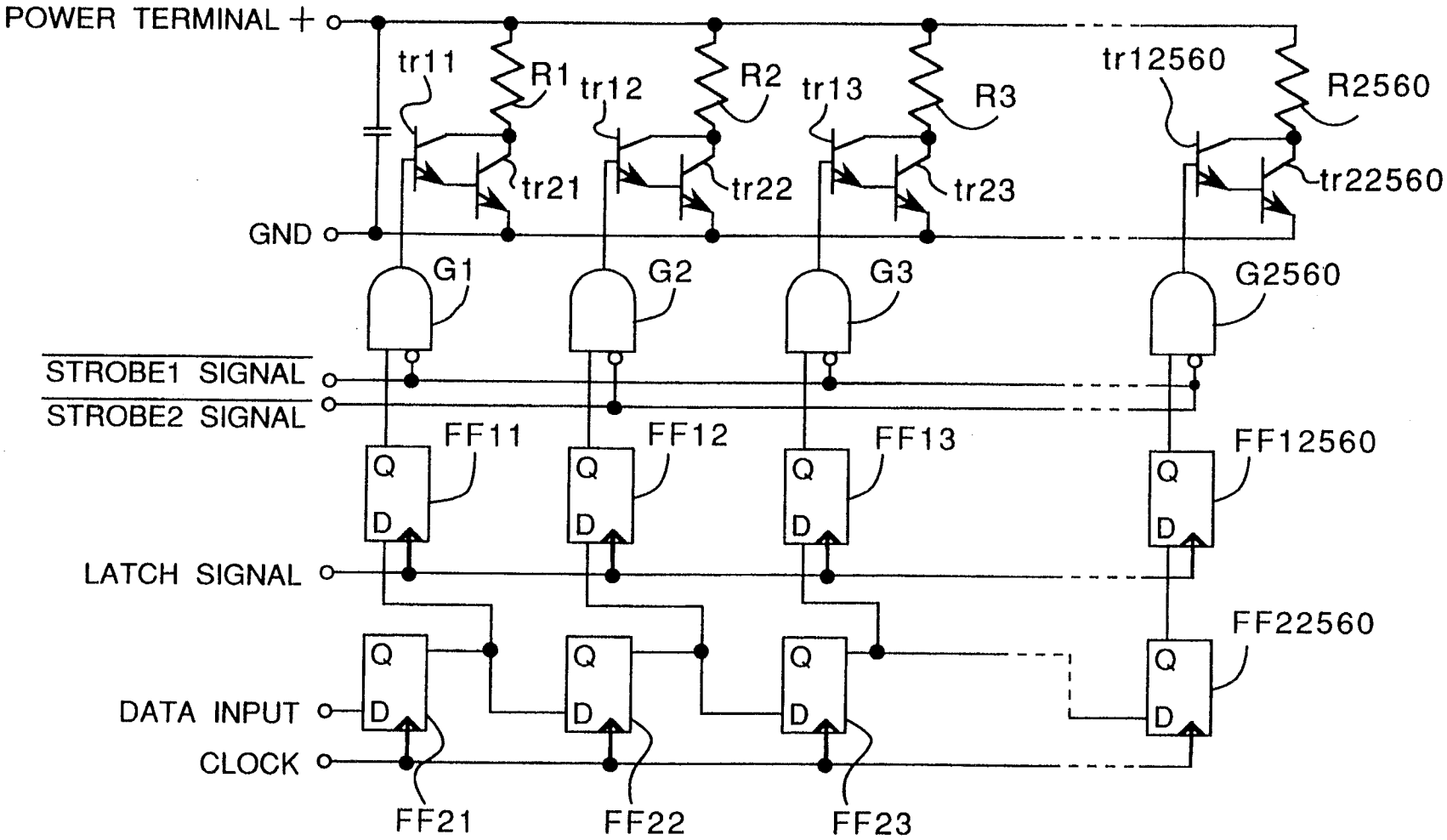
Fig. 11 (Prior Art)
FIG. 11 is a view of the construction of a thermal head driven by means of the thermal head drive unit in accordance with the conventional example.

FIG. 9 shows a flow chart of operations of the head drive control means in the thermal head drive unit according to the second embodiment of the present invention. As shown in FIG. 9, the increasing or decreasing operation of the electric power supply time for temperature compensation and resistance correction is carried out at the time of forming electric power supply time data based on gradation data input by the CPU 81 of the head drive control means 8 in step S'3 in the second embodiment. Therefore, the formed electric power supply data are stored in the first line memory 2*a* and the second line memory 2*b*, and the operations of the temperature compensation and resistance correction are carried out at the time of driving the thermal head 1.

The following describes a margin in the electric power supply time relevant to resistance correction in a practical case.

The resistance compensation is to increase or decrease the electric power supply time according to the resistance of each heat-generating resistor element so that the variance in produced heat energy due to deviation in resistance of the heat-generating resistor elements is made to coincide with a heat energy producible by a reference resistance.

$$(V^2/R)t=(V'^2/R)t' \quad (3)$$

The Equation 3 is given when a heat energy obtained by applying a voltage V to a heat-generating resistor element having a reference average resistance R for an electric power supply time t is made to coincide with a heat energy obtained by applying a voltage V to a heat-generating resistor element having a resistance R' for an electric power supply time t'. Therefore, an additional electric power supply time dt necessary for resistance correction can be expressed by the Equation 4 as follows.

$$dt=(t'-t)=(R'/R-1)t \quad (4)$$

The following describes the additional electric power supply time relevant to temperature compensation.

Since a recording unit employing a thermal head utilizes heat energy yielded by the thermal head, the recording density varies due to environmental temperature change and heat accumulation in the thermal head itself. The temperature compensation is to increase or decrease the electric power supply time to vary the heat energy according to environmental temperature change and heat accumulation in the thermal head so that a desired recording density can be obtained in any environmental temperature change or heat accumulation condition.

In general, a thermal recording unit employing a thermal head is often used in an environment at about a room temperature (20° C.), and therefore environmental temperature change must be taken into consideration. However, such a unit is used infrequently at a low temperature. It is noted that, when an image recording operation is repeated, the thermal head tends to have a temperature higher than the room temperature due to heat accumulation in the thermal head. In the thermal head drive unit-of the second embodiment of the present invention, the thermal head is designed to have a normal operation temperature at 30° C. frequently selected.

The following describes a case where the temperature compensation operation is carried out in a range of, for example, 5° C. to 50° C. A recording operation is carried out with the electric power supply time set up at one-line recording cycle tc at a low environmental temperature (5° C.), while a recording operation is carried out with the maximum electric power supply time tmax set up at each of several values at a normal temperature (30° C.). And then a maximum electric power supply time tmax at a normal temperature is obtained at the time the maximum density of an image recorded at the normal temperature with the maximum electric power supply time tmax set up at each of several values coincides with the density of an image recorded at the recording start time at a low temperature. Therefore, the additional electric power supply time relevant to temperature compensation can be derived by taking the difference between the one-line recording cycle tc and the maximum electric power supply time tmax. It is noted that the supply electric power is set at the same value as that in the first embodiment for the purpose of preventing the possible occurrence of density reduction and image deterioration due to thermal deformation of recording paper as described on the first embodiment.

As described above, with the deviation in resistance of the heat-generating resistor elements to be corrected in a resistance correction operation being within a range of 10% and the temperature compensation being effected in a range from a low temperature (5° C.) to a high temperature (50° C.), the additional electric power supply time necessary for the resistance correction and temperature compensation was about 3 milliseconds according to Equation 4 and the above-mentioned experiment. It is noted that the one-line recording time was fixed at 16.4 milliseconds.

When the additional electric power supply time is set at about 3 milliseconds corresponding to the intermission time td of about 3 milliseconds in a recording operation at a normal temperature where a longer intermission time exists as compared with the case that no intermission time exists, image quality is virtually deteriorated less by the tailing phenomenon. Furthermore, the condition that the additional electric power supply time is fully used to almost eliminate the intermission time is permitted only when the resistance of each heat-generating resistor element is greater than the average value and the gradation level at a low temperature is great in recording a comparatively high-density area. Since the recording image is in the high-density area in the above case, image quality deterioration due to the tailing phenomenon is hardly recognized by human beings. The above permits introduction of resistance correction and temperature compensation virtually incurring no image quality deterioration to enable recording a high-quality image having an improved gradation reproducibility with a higher energy use efficiency.

In the present invention, an intermission time in one-line recording time can be easily set up at a desired value by the head drive control means 8 comprising the microcomputer according to an image to be recorded and the application purpose of the unit without providing any additional unit.

Although the head drive control means 8 is constructed by the microcomputer, the drive control means 8 can be also constructed only by a hardware comprising such as a counter, a timer, etc. set up at the optimum intermission time.

As described above, the present invention permits use of only one strobe signal to drive the thermal head in a lump to enable making the thermal head and the head drive unit have a simple construction as compared with a conventional example, which leads to cost reduction. With continuous electric power supply to the heat-generating resistor elements according to gradation data for each line, the heat-generating resistor element can be made to have a long life span.

Furthermore, the electric power supply means supplies to the heat-generating resistor elements such maximum electric power that the heat-generating resistor elements yields a maximum temperature lower than the temperature at which a color-generating recording paper or a recording paper reproducing an image through ink transfer deforms, which enables preventing the possible recording paper surface from deformation, and preventing recording density reduction, and image quality deterioration.

By satisfying the intermission time conditions as described on the first embodiment, energy applied to one recording line can be efficiently used for recording the next line while suppressing heat temperature reduction in each recording line during the intermission time without incurring the tailing phenomenon.

Particularly according to the second embodiment of the present invention, resistance correction and temperature compensation can be introduced virtually incurring no quality deterioration in a recorded image to enable recording high-quality image having an improved gradation reproducibility with a higher energy use efficiency.

For the reason that the head drive control means comprises a microcomputer, an optimum intermission time between lines can be easily set up according to the application purpose of the unit in regard of recording speed, recording image quality, etc. without changing the hardware construction, which produces a great practical effect.

Although the present invention has been fully described by way of example with reference to the accompanying drawings, it is to be noted here that various changes and modifications will be apparent to those skilled in the art. Therefore, unless otherwise such changes and modifications depart from the scope of the present invention as defined by the appended claims, they should be construed as included therein.

What is claimed is:

1. A thermal head drive unit using recording paper for forming thereon an image through a color generation or ink transfer process comprising:

electric power supply means for supplying electric power to heat-generating resistor elements arranged in a line in a thermal head;

head drive means for electrically driving the heat-generating resistor elements in a lump by supplying, as a function of gradation data, electric power continuously variably in time to said heat-generating resistor elements depending on input gradation data; and head drive control means for controlling said head drive means so that, in a one-line recording time period composed of a power supply time during which electric power is supplied to said heat-generating resistor elements and an intermission time during which no electric power is supplied to said heat-generating resistor elements in disregard of the gradation data, the intermission time occupies a part not more than approximately 40% in the one-line recording time period.

2. The thermal head drive unit as claimed in claim 1, wherein said electric power supply means supplies such maximum electric power that a temperature of said heat-generating resistor elements is maintained lower than a temperature at which deformation of the recording paper is caused.

3. The thermal head drive unit as claimed in claim 2, wherein said head drive means further comprises:

drive signal generating means for generating a drive timing signal to be input to the thermal head;

first and second line memory units for storing electric power supply time data for supplying electric power to said heat-generating resistor elements according to the input gradation data;

first changeover means for changing over between an address to be given to said first line memory unit and an address to be given to said second line memory unit;

second changeover means for changing over between an output from said first line memory unit and an output from said second line memory unit;

first counter means for giving addresses to said first line memory unit and second line memory unit by said first changeover means;

second counter means for generating a recording gradation level; and comparator means for comparing any one of the output from said first line memory unit and said second line memory unit with an output of said second counter means, and wherein said head drive control means controls said first counter means, said second counter means, said first changeover means, and the second changeover means in recording each line to produce time data for supplying electric power to said heat-generating resistor elements based on the input gradation data.

4. A thermal head drive unit using recording paper for forming thereon an image through a color generation or ink transfer process comprising:

electric power supply means for supplying electric power to heat-generating resistor elements arranged in a line in a thermal head;

head drive means for electrically driving the heat-generating resistor elements in a lump by supplying electric power continuously variably in time to said heat-generating resistor elements depending on input gradation data; and head drive control means for controlling said head drive means so that, in a one-line recording time period composed of a power supply time during which electric power is supplied to said heat-generating resistor elements and an intermission time during which no electric power is supplied to said heat-generating resistor elements in disregard of the gradation data, the intermission time occupies a part not more than approximately 40% in the one-line recording time period, said head drive control means controls said head drive means so that substantially no intermission time is provided in a compensation time period for carrying out a compensation operation with maximum additional electric power supply necessary for compensating for recording density variance attributed to environmental temperature change and heat accumulation in the thermal head or for compensating for recording density variance attributed to deviation in resistance of the heat-generating resistor elements.

5. The thermal head drive unit as claimed in claim 4, wherein said head drive means further comprises:

drive signal generating means for generating a drive timing signal to be input to the thermal head;

first and second line memory units for storing electric power supply time data for supplying electric power to said heat generating resistor elements according to the input gradation data;

first changeover means for changing over between an address to be given to said first line memory unit and an address to be given to said second line memory unit;

second changeover means for changing over between an output from said first line memory unit and an output from said second line memory unit;

first counter means for giving addresses to said first line memory unit and second line memory unit by said first changeover means;

second counter means for generating a recording gradation level; and comparator means for comparing any one of the output from said first line memory unit and said second line memory unit with an output of said second counter means, and wherein said head drive control means controls said first counter means, said second counter means, said first changeover means, and the second changeover means in recording each line to produce time data for supplying electric power to said heat-generating resistor elements based on the input gradation data.

6. A thermal head drive unit using recording paper for forming thereon an image through a color generation or ink transfer process comprising:

electric power supply means for supplying electric power to heat-generating resistor elements arranged in a line in a thermal head, wherein said electric power supply means supplies such maximum electric power that a temperature of said heat-generating resistor elements is maintained lower than a temperature at which deformation of the recording paper is caused;

head drive means for electrically driving the heat-generating resistor elements in a lump by supplying electric power continuously variably in time to said heat-generating resistor elements depending on input gradation data; and head drive control means for controlling said head drive means so that, in a one-line recording time period composed of a power supply time during which electric power is supplied to said heat-generating resistor elements and an intermission time during which no electric power is supplied to said heat-generating resistor elements in disregard of the gradation data, the intermission time occupies a part not more than approximately 40% in the one-line recording time period, said head drive control means controls said head drive means so that substantially no intermission time is provided in a compensation time period for carrying out a compensation operation with maximum additional electric power supply necessary for compensating for recording density variance attributed to environmental temperature change and heat accumulation in the thermal head or for compensating for recording density variance attributed to deviation in resistance of the heat-generating resistor elements.

* * * * *